US007008310B2

(12) United States Patent
Andres

(10) Patent No.: US 7,008,310 B2
(45) Date of Patent: Mar. 7, 2006

(54) WAFER CARRIER WEAR INDICATOR

(75) Inventor: Todd E. Andres, Evergreen, CO (US)

(73) Assignee: Entegris, Inc., Chaska, MN (US)

( * ) Notice: Subject to any disclaimer, the term of this patent is extended or adjusted under 35 U.S.C. 154(b) by 37 days.

(21) Appl. No.: 10/210,789

(22) Filed: Aug. 1, 2002

(65) Prior Publication Data

US 2003/0040260 A1 Feb. 27, 2003

Related U.S. Application Data

(60) Provisional application No. 60/309,314, filed on Aug. 1, 2001.

(51) Int. Cl.
*B24B 19/00* (2006.01)

(52) U.S. Cl. ..... 451/398; 451/63; 451/262; 451/269; 451/402

(58) Field of Classification Search ..... 451/41, 451/59, 63, 262, 263, 264, 265, 266, 267, 451/268, 269, 270, 271, 364, 390, 397, 398, 451/402

See application file for complete search history.

(56) References Cited

U.S. PATENT DOCUMENTS 4,019,289 A * 4/1977 Korver ..... 451/527
4,239,567 A 12/1980 Winings
5,655,475 A 8/1997 Crandell et al.
5,736,427 A * 4/1998 Henderson ..... 438/14
5,882,245 A 3/1999 Popovich et al.
5,913,713 A * 6/1999 Cheek et al. ..... 451/41
5,967,885 A 10/1999 Crevasse et al.
6,106,661 A 8/2000 Raeder et al.
6,136,043 A * 10/2000 Robinson et al. ..... 8/485
6,390,908 B1 5/2002 Chen et al.
6,394,023 B1 5/2002 Crocker
6,454,635 B1 * 9/2002 Zhang et al. ..... 451/41

OTHER PUBLICATIONS

International Search Report.

* cited by examiner

*Primary Examiner*—Timothy V. Eley
(74) *Attorney, Agent, or Firm*—Patterson, Thuente, Skaar & Christensen, P.A.

(57) ABSTRACT

A wafer carrier for use in polishing disks. The wafer carrier includes a main body and an integral visual inspection wear indicator. The main body has at least one opening formed therein adapted to receive a disk. The visual inspection wear indicator provides a visual indication of when the main body has reached the end of its useful life. The inspection wear indicator may have several portions to incrementally identify the approximate wear stage, that is, the approximate remaining useful life.

25 Claims, 5 Drawing Sheets

WAFER CARRIER WEAR INDICATOR

REFERENCES TO RELATED APPLICATIONS

This application is based upon U.S. Provisional Application Ser. No. 60/309,314 filed on Aug. 1, 2001 which is hereby incorporated by reference herein.

BACKGROUND OF THE INVENTION

The present invention relates generally to a wafer carrier. More particularly, the present invention relates to a wafer carrier with a wear indicator for use in disk polishing processes.

Hard disk drives used in computers or similar devices contain aluminum or ceramic disks for storing data. As the need to store increasingly more information on the disks increases, the disks must have extremely smooth and flat surfaces. Similarly, wafers used in fabricating components used in computers are also required to exhibit extremely smooth and flat surfaces to facilitate the extremely close placement of the components on the wafers. "Disk" when used herein includes the substrates utilized for hard disk drives as well as the wafers for manufacturing semiconductor components.

Since it is typically not possible to directly fabricate such disks with the requisite levels of smoothness and flatness, the disks must be polished to obtain the desired levels. During the polishing process, the disks are placed in a consumable flat disk carrier that is used to transport the disks through the polishing process. The disk carrier has a plurality of openings therein that are each adapted to receive one of the disks. The carrier with the disks therein are placed in between platens of a polishing equipment and are rotated as the platens are moving. To facilitate the controlled rotation of the disk carriers in the polishing apparatus, the disk carriers typically have a circular shape and a plurality of gear teeth extending from an outer edge thereof.

Disk carriers have previously been fabricated from sheet metal. While the metal disk carriers provided a high level of support to the disks during the polishing process, the metal disk carriers produce an undesirably high level of abrasives during the polishing process.

In an attempt to overcome the limitations associated with metal disk carriers, disk carriers have been fabricated from fiberglass-reinforced epoxy. These types of disk carriers are typically fabricated using thermoset resins that are molded using composite lay-up techniques. While these types of disk carriers provide desirable strength characteristics, the polishing process causes fiberglass particulates to be released from the epoxy-glass composite disk carrier. Such fiberglass particulates act as abrasives during the polishing process, which scratch the disk surfaces and thereby increase the disk rejection rates, in many instances approaching 15 percent disk rejection.

These disk carriers exhibit severe wear in the gear tooth region. As these disk carriers wear, increasing amounts of fiberglass are released into the polishing slurry. Once the rejection percentage exceeds a threshold level, the fiberglass reinforced epoxy disk carriers are replaced.

Non-abrasive disk carriers, may not exhibit such significant levels of wear in the gear tooth region. Rather, degradation of the non-abrasive disk carriers is often evidenced by tooth failure where one or more of the teeth break off resulting in a crash during the polishing operation. The tooth failure can be corrected to wear off the surface of the carrier.

For example, Winings, U.S. Pat. No. 4,239,567, discloses forming the disk carrier with a polyurethane upper surface. Popovich et al., U.S. Pat. No. 5,882,245, discloses forming the base disk carrier from polyetheretherketone by extrusion, rolling or calendaring and applying additional layers or coatings on the base disk carrier. These two patents are incorporated herein by reference.

One technique that is frequently used to track the life of the disk carrier is to count the number of times that the disk carrier has been used. Once the disk carrier has been used a specified number of times, the disk carrier is replaced. Typically, the disk carriers are replaced after 100 uses.

Although it is presumed polishing disk carriers are consumable, it is economically advantageous to obtain as many uses of the disk carrier as possible without effecting yield. Optimal life expectancy of disk carriers may be empirically determined and such life expectancy can be correlated with wear. Wear indicators for laminations of laminated polishing disk carriers are known. Popovich, supra, discloses placement of an adhesion promoter on a 0.5 mm thick base sheet of polyetheretherketone, applying or printing a geometric pattern such as lines, dots, or figures, and then laminating a 0.05 mm thick film of resin thereon. Popovich identifies that observation of the geometric pattern provides a simple method for visual inspection of the integrity of the coating on the base and provides no means of measuring wear of the base portion of the wafer carrier nor prediction of failure of the wafer carrier.

A simpler and more versatile method and system is needed to monitor wear of polishing disk carriers. Such a method should provide incremental indication of the useful life cycle of the carrier.

SUMMARY OF THE INVENTION

The present invention relates to a wafer carrier for use in polishing disks. The wafer carrier includes thin compression-injection molded main body with an integral means for indicating wear. The main body has at least one disk opening formed therein adapted to receive the disks for polishing. In a preferred embodiment, the means for indicating wear is integrally molded with the main body and is formed by providing visually differentiable structure at the surface of the disk carrier that is subject to wear or visual alternation during the polishing operation. The "structure" may have varying elevations or depths with respect to the thickness of the disk and may comprise indicia such as words or graduated indicator portions to incrementally gauge wear. As portions of the wear indicator are worn down during repeated uses, the visual appearance of the wear indicator changes providing a visual indication of the amount of life remaining in the disk.

In other embodiments the visual wear indicators may be machine readable such as a plurality of bar code segments formed on the surface of the disk. The bar code may have segments at varying elevations such that incrementally bar code segments are worn, or effectively erased, thereby leaving particular bar code segments that provide data such as identifying the useful carrier life remaining.

In other embodiments the indicators may have textured portions such as by mechanical, chemical, or laser etching that are visually altered, for example, smoothed out during the polishing operations to provide visually the remaining useful life of the disk carrier.

The present invention also relates to a method of polishing disks. The method includes molding or otherwise fabricating integral wear indicators on polishing disk carriers, polishing disks in the disk carrier in a polishing apparatus, and visually observing the wear indicator to determine when the disk carrier should be replaced.

A feature and advantage of the invention is that the structure providing the wear indicator can be formed during the injection molding or by a subsequent process. No secondary operations such as layering of materials or applications of printing intermediate layers, as is taught by the prior art, is used.

A feature and advantage of the invention is that varying levels of wear may be indicated by the integral visual wear indicators by having portions of the wear indicators at different elevations or of different textures at the surface of the disks.

DETAILED DESCRIPTION OF PREFERRED EMBODIMENTS

Figure 1:
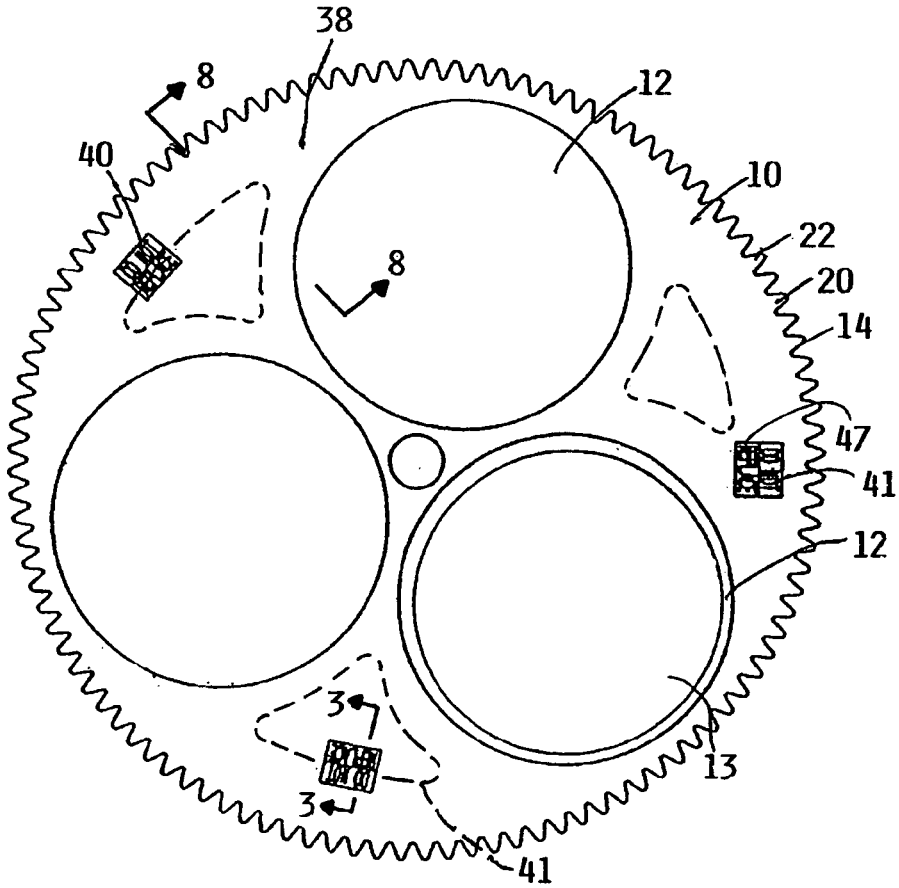
FIG. 1 is a top view of a disk carrier of the present invention with visual wear indicators thereon.

The present invention is directed to a disk carrier for use in polishing disks for substrates such as used in hard disk drives and integrated circuit chips. The disk carrier 10 includes at least one opening 12 formed therein that is adapted to receive a disk 13, as most clearly illustrated in FIG. 1. The disk carrier 10 preferably has a substantially circular configuration 14 with a top surface 16, a bottom surface 18, and with a plurality of teeth 20 extending from an edge surface 22 thereof.

The disk carrier 10 of the present invention enhances the accuracy of tracking the usable life of the disk carrier. Therefore, the present invention maximizes the duration in which the disk carrier 10 is used and replaces before the disk carrier 10 before the disk carrier is statistically calculated to fail. The disk carrier 10 of the present invention thereby improves disk yield, reduces manufacturing costs and removes the reliance on operators associated with manual counting techniques.

Figure 3:
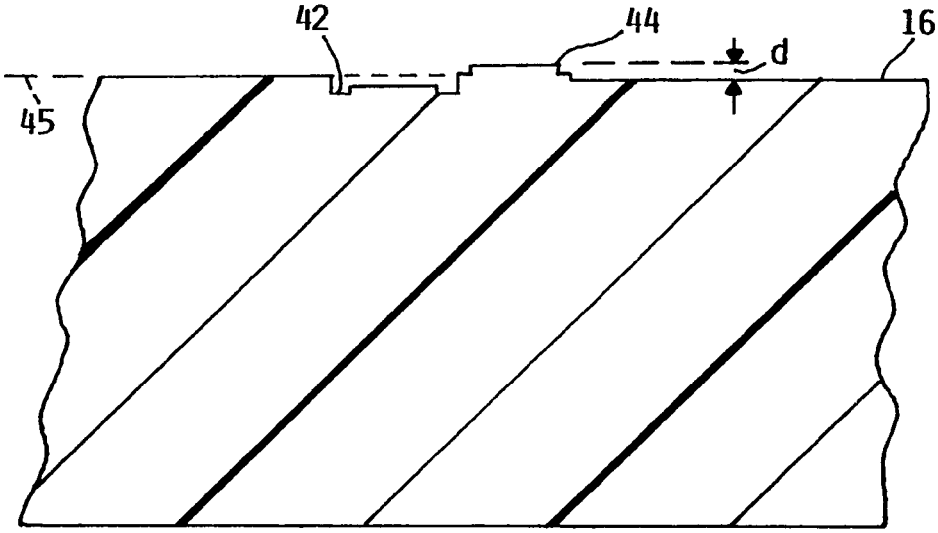
FIG. 3 is a sectional view of the integral visual wear indicator taken along a line 3—3 in FIG. 1.
Figure 2:
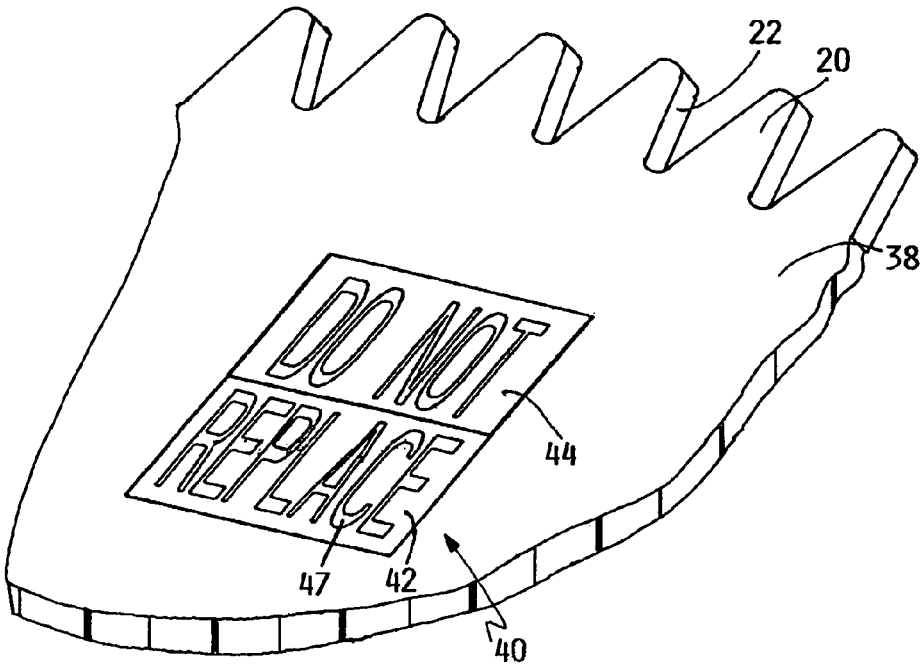
FIG. 2 is a perspective view of a visual wear indicator of the disk carrier of FIG. 1.

The present invention is directed to a means for indicating wear configured as a visual inspection wear indicator 40 formed by integral structure 41 on a main body portion 38 of the disk carrier 10, as illustrated in FIGS. 1, 2 and 3. The visual inspection wear indicator 40 provides operators with the ability to make a quick visual inspection of the disk carrier 10 to determine whether the disk carrier 10 should be replaced.

The visual inspection wear indicator 40 may be configured of several portions. In a preferred embodiment of FIGS. 1, 2, and 3, a first indicator portion 42 is recessed into a surface of the disk carrier 10. The first indicator portion 42 is generally not subject to wear during the polishing operation such that the first indicator portion 42 remains present on the disk carrier 10 until after the useful life of the disk carrier 10 is over. The first indicator portion 42 thereby provides a visual cue to the operator as to the location of the visual inspection wear indicator 40.

A second indicator portion 44 is located at or above the top surface 16 of the disk carrier 10. The second indicator portion 44 is gradually worn off the surface of the disk carrier 10 during the polishing operations. When the second indicator portion 44 is completely worn off the disk carrier 10, the useful life of the disk carrier 10 is substantially over and the disk carrier 10 should be replaced.

The second indicator portion 44 extends from a top surface 16 of the disk carrier 10 a distance d based upon the material from which the disk carrier is fabricated as well as other parameters associated with the polishing. The second indicator portion 44 is preferably fabricated from the same material as the disk carrier 10 and is integral therewith. In a preferred embodiment, it has been found that it is appropriate for the second indicator portion 44 to extends from the top surface 16 of the disk carrier 10 less than 0.010 inches and ideally about 0.005 inches and 0.001 inches.

In one preferred embodiment, the first indicator portion 42 may include indicia 47 with terminology such as "REPLACE" and the second indicator portion 44 may include indicia 48 with terminology such as the word "NOT." In another preferred embodiment, the second indicator portion 44, comprising the word "NOT" is placed intermediate the first indicator portion 42 comprising the words "REPLACEMENT" and "REQUIRED" to produce the phrase "REPLACEMENT NOT REQUIRED."

Once the useful life of the disk carrier 10 is substantially over and the second indicator "NOT" is worn off the surface of the disk carrier 10, the phrase reads "REPLACEMENT REQUIRED." Reading this phrase thereby notifies the operator that the disk carrier 10 has reached the end of its useful life to thereby encourage the operator to replace the disk carrier 10.

The visual inspection wear indicator 40 is preferably removably mounted in the disk carrier 10 so that a visual inspection wear indicator 40 having a selected life indication may be used in the disk carrier 10 based upon a variety of factors including the composition of the disk carrier, the composition of the disk, the composition of the polishing slurry and the conditions under which the polishing operation is performed.

Figure 4:
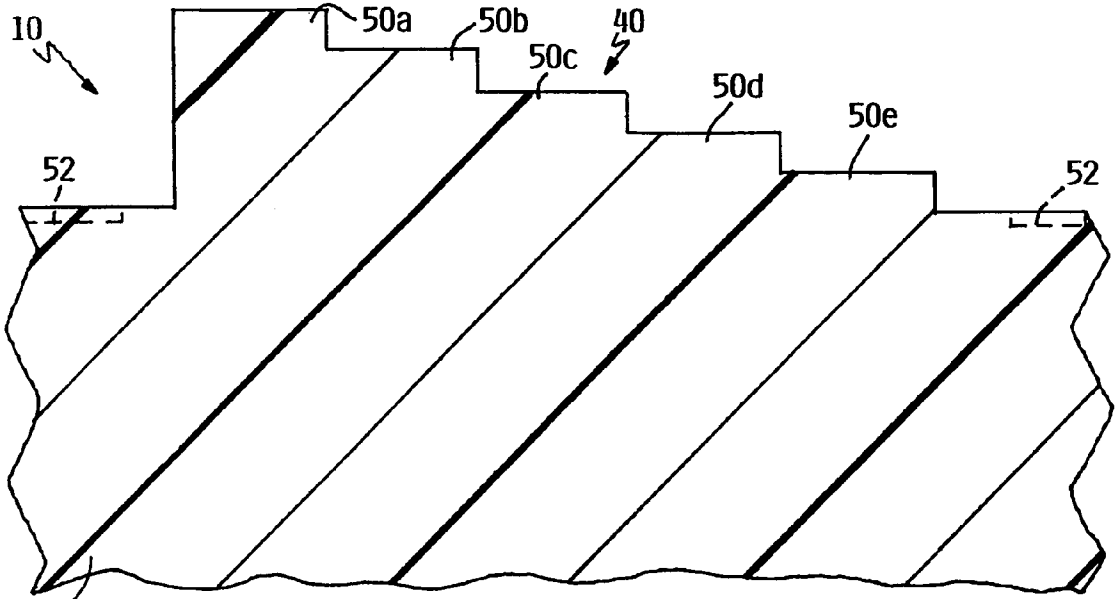
FIG. 4 is a sectional view of an alternative configuration for a visual inspection wear indicator.
Figure 5:
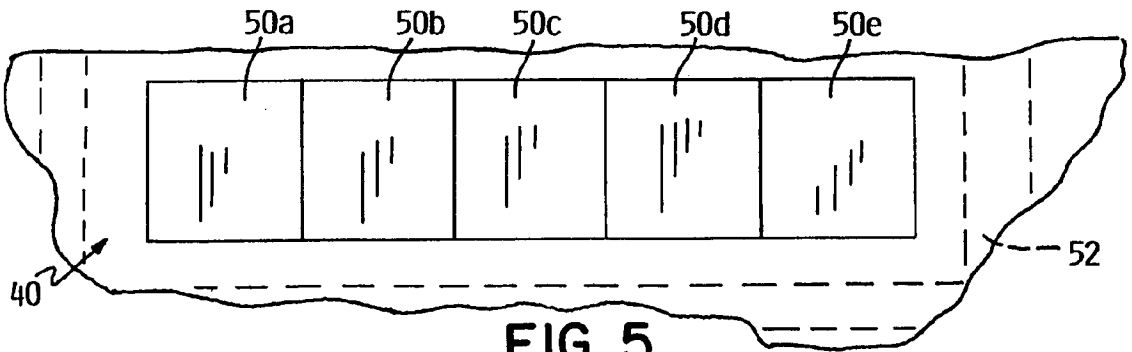
FIG. 5 is a top plan view of the alternative visual inspection wear indicator illustrated in FIG. 4.

Referring to FIGS. 4 and 5, in another preferred embodiment, the visual inspection indicator 40 may include a graduated configuration that possesses a series of wear indicators 50*a*, 50*b*, 50*c*, 50*d*, 50*c* that are located a different heights above the disk carrier. In addition to providing an indication as to when the disk carrier 10 should be replaced, the visual indication wear indicator 40 in this embodiment also provides the operator with an indication as to where the disk carrier is in its useful life cycle.

The wear indicators 50*a*, 50*b*, 50*c*, 50*d*, 50*e* are preferably oriented adjacent to each other so that they gradually decrease in elevation. By counting of the number of remaining steps, the operator is able to determine how much of the useful life of the disk carrier 10 remains. For example, when all of the wear indicators 50*a*, 50*b*, 50*c*, 50*d*, 50*e* are worn down to the same height, the disk carrier 10 should be replaced. The wear indicators 50*a*, 50*b*, 50*c*, 50*d*, 50*e* may increase in elevation such as in increments of 0.001 inch. The wear indicators 50*a*, 50*b*, 50*c*, 50*d*, 50*e* preferably have a width of approximately 0.125 inches.

It is also possible to incorporate a wear indicator location identifier 52 into this embodiment. The location indicating identifier 52 is preferably recessed into the surface of the disk carrier 10 so that the location indicating identifier 52 does not wear off the disk carrier 10 during use of the disk carrier 10. The location indicating identifier 52 indicates to the operator the location of the visual inspection wear indicator 40.

As illustrated in FIG. 1, it may be desirable to place more than one visual inspection wear indicator 40 on the disk carrier 10. Using more than one visual inspection wear indicator 40 enables the operator to ascertain whether the disk carrier 10 is undergoing even wear during the polishing operation.

Figure 6:
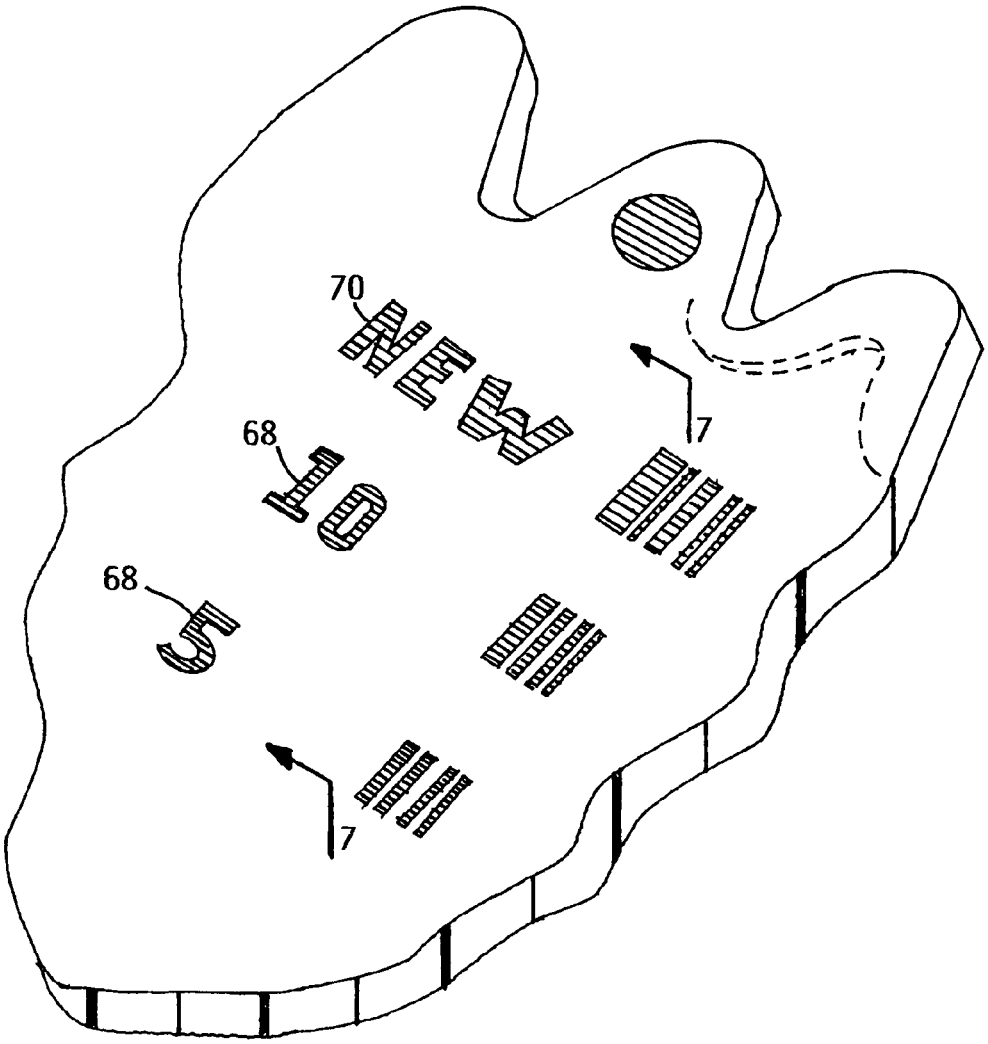
FIG. 6 is a perspective view of a portion of a wafer carrier illustrating different embodiments of visual wear indicators.
Figure 7:
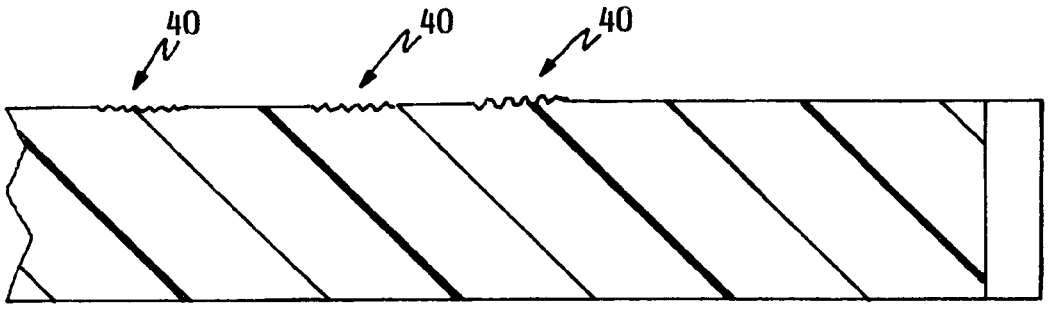
FIG. 7 is a cross-sectional view of the disk carrier of FIG. 6 illustrating variations in etching of three wear indicators.
Figure 8:
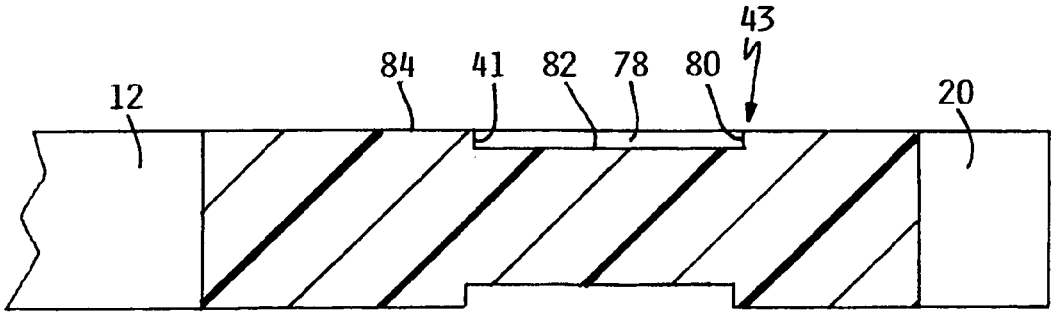
FIG. 8 is a cross-sectional view of the disk carrier of FIG. 1.

Referring to FIGS. 6, 7, and 8, further preferred embodiments are illustrated. These embodiments have the wear indicators forming incremental gauging indicia such as numbers 68 which can be indicative of uses remaining or descriptive terms 70, i.e., "NEW", and bar codes. As an alternative to or in addition wear indicators utilizing different elevation levels, means for indicating wear may utilize a surface texture or roughness formed to provide visual differentiation from the other surface of the wafer. Such texture may be provided during the mold process or subsequent thereto such as by etching, mechanically, chemically, or by laser. As illustrated in FIG. 7, various levels of roughness can be utilized to provide indication of the specific stages in the life cycle of the carrier. Such portions can utilize indicia such as numbers, words, or bar codes to provide specific indicators for indicating remaining useful life and can be at the surface level of the carrier or slightly offset therefrom. The smoothing or polishing of roughened portions correlate to the life cycle of the carrier, although the specific correlation characteristics will typically differ from the correlation characteristic of the wear of the elevated wear indicators such as illustrated in FIGS. 4 and 5. As such, the means for indicating wear configured as an elevated indicator portion may be combined with the means for indicating wear configured as a textured surface to provide an optimal wear indication means.

Referring to FIGS. 8 and 1, an alternative embodiment utilizes structure on the top and/or bottom configured as recesses 78 with an upright interface 80 extending between two levels 82, 84. The interface may form the means for indicating wear 43 that provides a replacement indication when the interface is worn smooth.

The different thickness of the disk carrier provided by the recesses 78 are also believed to provide some strength advantages and other functional advantage.

Changes in cycle duration and polishing pad loading impact disk carrier 10 fatigue. However, since the visual inspection wear indicator 40 is dependent upon cycle duration and polishing pad loading, the visual inspection wear indicator 40 automatically accounts for these variations and thereby enables the disk carriers 10 to be used for the maximum amount of time while avoiding crashes associated with disk carrier 10 failure.

Disk carriers 10 used in conjunction with the present invention preferably have a diameter of between 6 inches and 32 inches and a thickness of between 0.012 inches and 0.044 inches.

The disk carrier 10 is preferably fabricated from high strength polymers and does not require the use of fiberglass reinforcements to obtain the necessary strength and rigidity characteristics. The polymers used in fabricating the disk carriers 10 are melt processable and have the characteristics set forth below. Fabricating the disk carriers 10 in this manner reduces the degradation of the disk carriers 10 associated with wear and thereby enhances the useful life of the disk carriers 10.

In preferred embodiments, the high strength polymers used in conjunction with the present invention have a flexural modulus, as defined by ASTM D790, of greater than 300,000 psi. The flexural modulus is preferably between 400,000 psi and 600,000 psi and more preferably about 500,000 psi.

In preferred embodiments, the high strength polymers used in conjunction with the present invention have a flexural strength, as defined by ASTM D790, of greater than about 15,000 psi. The flexural strength is preferably between 17,000 psi and 23,000 psi and more preferably about 20,000 psi.

As an alternative or in addition to possessing a flexural modulus and a flexural strength in the preceding ranges, in preferred embodiments the high strength polymers have a tensile strength, as defined by ASTM D638, of greater than 10,000 psi and a tensile strength modulus, as defined by ASTM D638, of greater than 300,000 psi. The tensile strength is preferably between 12,000 psi and 17,000 psi, and more preferably is about 15,000 psi. The tensile strength modulus is preferably between 350,000 psi and 450,000 psi, and more preferably is about 400,000 psi.

The disk carriers may be fabricated from melt processable polymer blends. Examples of suitable polymers include poly(amide-imide) and high strength nylon. A person of ordinary skill in the art will appreciate that is it possible to use other materials to fabricate the disk carrier 10 possessing the preceding characteristics.

To enhance the strength of the disk carriers, non-abrasive fillers such as polyimide or other high strength fibers can be used along with the processable polymer blends. Examples of suitable reinforcing materials include aramid reinforced polyetheretherketone, liquid crystal polyester, polyethersulfone, polysulfone, thermoplastic polyimide, nylon, and poly (amide-imide).

In addition to the other components, the polymer may also include compatible lubricant. The lubricant reduces the disk carrier wear thereby reducing particulate production and increasing the usable life of the disk carrier.

The disk carriers 10 are preferably manufactured using a compression-injection molding technique. Using this technique, molten plastic is injection into a partially open mold. Thereafter, the mold is closed to impart a compressing force on the plastic. The compressing force urges the plastic into all regions of the mold and thereby enables a disk carrier that is thin and very flat to be produced. Such a compression injection molding process is disclosed by U.S. patent application Ser. No. 09/397,580, entitled "Molded Non-Abrasive Substrate Carrier for Use in Polishing Operations," filed Sep. 16, 1999 with Todd Andres as the inventor and owned by the owner of this application. Said application is hereby incorporated by reference.

The wear indicators may be formed by removable mold inserts. It is contemplated that a variety of mold inserts for molding wear indicators with different elevations or roughness levels will be available and that a specific insert may be selected based on specific carrier material to be molded with desired wear indication characteristics.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A wafer carrier for use in polishing disks, the wafer carrier comprising:

a main body having at least one opening formed therein, wherein each of the at least one opening is adapted to receive a disk; and a visual inspection wear indicator operably integrally molded into the main body to provide a visual indication of when the main body has reached the end of its useful life, the visual wear indicator including a first indicator portion and a second indicator portion, wherein the first indicator portion remains present on the main body after the useful life of the wafer carrier, and wherein the second indicator portion is worn off the main body to indicate that the wafer carrier has reached the end of its useful life.

2. The disk carrier of claim 1, wherein the first indicator portion and the second indicator portion form a phrase indicating that replacement is not needed, and wherein the first indicator portion forms a phrase indicating that replacement is needed.

3. The disk carrier of claim 1, wherein the second indicator portion has a graduated configuration that indicates the portion of the useful life of the disk carrier that remains.

4. The disk carrier of claim 3, wherein the second indicator portion includes a series of wear indicators that each have a different height.

5. The disk carrier of claim 1, wherein the main body is fabricated using a compression injection molding technique.

6. The disk carrier of claim 1, wherein the main body has a flexural modulus of greater than about 300,000 psi, as defined by ASTM D790, and a flexural strength of greater than about 15,000 psi, as defined by ASTM D790.

7. The disk carrier of claim 1, wherein the main body has a tensile strength of greater than about 10,000 psi, as defined by ASTM D638, and a tensile strength modulus of greater than about 300,000 psi, as defined by ASTM D638.

8. The disk carrier of claim 1, wherein the main body is fabricated from poly(amide-imide), polyetheretherketone, polysulfone, polyethersulfone, thermoplastic polyimide, nylon or liquid crystal polyester.

9. The disk carrier of claim 1, wherein main body is reinforced with a non-abrasive filler.

10. A wafer carrier for use in polishing disks, the wafer carrier comprising:

a main body having at least one opening formed therein, wherein each of the at least one opening is adapted to receive a disk; and a visual inspection wear indicator operably attached to the main body to provide a visual indication of when the main body has reached the end of its useful life, the visual wear indicator including a first indicator portion and a second indicator portion, wherein the first indicator portion and the second indicator portion form a phrase indicating that replacement is not needed, wherein the first indicator portion forms a phrase indicating that replacement is needed, wherein the first indicator portion remains present on the main body after the useful life of the wafer carrier, and wherein the second indicator portion is worn off the main body to indicate that the wafer carrier has reached the end of its useful life.

11. The disk carrier of claim 10, wherein the visual inspection wear indicator is integrally molded into the main body.

12. The disk carrier of claim 10, wherein the visual inspection wear indicator is removably attached to the main body.

13. The disk carrier of claim 10, wherein the main body is fabricated using a compression injection molding technique.

14. The disk carrier of claim 10, wherein the main body has a flexural modulus of greater than about 300,000 psi, as defined by ASTM D790, and a flexural strength of greater than about 15,000 psi, as defined by ASTM D790.

15. The disk carrier of claim 10, wherein the main body has a tensile strength of greater than about 10,000 psi, as defined by ASTM D638, and a tensile strength modulus of greater than about 300,000 psi, as defined by ASTM D638.

16. The disk carrier of claim 10, wherein the main body is fabricated from poly(amide-imide), polyetheretherketone, polysulfone, polyethersulfone, thermoplastic polyimide, nylon or liquid crystal polyester.

17. The disk carrier of claim 10, wherein main body is reinforced with a non-abrasive filler.

18. A wafer carrier for use in polishing disks, the wafer carrier comprising:

a main body having at least one opening formed therein, wherein each of the at least one opening is adapted to receive a disk; and a visual inspection wear indicator operably attached to the main body to provide a visual indication of when the main body has reached the end of its useful life, the visual wear indicator including a first indicator portion and a second indicator portion, wherein the second indicator portion has a graduated configuration that indicates the portion of the useful life of the disk carrier that remains and includes a series of wear indicators that each has a different height, wherein the second indicator portion is worn off the main body to indicate that the wafer carrier has reached the end of its useful life, and wherein the first indicator portion remains present on the main body after the useful life of the wafer carrier.

19. The disk carrier of claim 18, wherein the visual inspection wear indicator is integrally molded into the main body.

20. The disk carrier of claim 18, wherein the visual inspection wear indicator is removably attached to the main body.

21. The disk carrier of claim 18, wherein the main body is fabricated using a compression injection molding technique.

22. The disk carrier of claim 18, wherein the main body has a flexural modulus of greater than about 300,000 psi, as defined by ASTM D790, and a flexural strength of greater than about 15,000 psi, as defined by ASTM D790.

23. The disk carrier of claim 18, wherein the main body has a tensile strength of greater than about 10,000 psi, as defined by ASTM D638, and a tensile strength modulus of greater than about 300,000 psi, as defined by ASTM D638.

24. The disk carrier of claim 18, wherein the main body is fabricated from poly(amide-imide), polyetheretherketone, polysulfone, polyethersulfone, thermoplastic polyimide, nylon or liquid crystal polyester.

25. The disk carrier of claim 18, wherein main body is reinforced with a non-abrasive filler.

* * * * *

UNITED STATES PATENT AND TRADEMARK OFFICE

CERTIFICATE OF CORRECTION

PATENT NO. : 7,008,310 B2
APPLICATION NO. : 10/210789
DATED : March 7, 2006
INVENTOR(S) : Todd E. Andres It is certified that error appears in the above-identified patent and that said Letters Patent is hereby corrected as shown below:

Col. 4, line 51, delete “50c” and insert --50e--

Col. 4, line 51, delete “a” and insert --at--

Signed and Sealed this

Seventh Day of August, 2007

JON W. DUDAS
*Director of the United States Patent and Trademark Office*